US009543664B2

(12) United States Patent
Sabo

(10) Patent No.: US 9,543,664 B2
(45) Date of Patent: Jan. 10, 2017

(54) INSULATION DISPLACEMENT CONNECTOR

(71) Applicant: FCI Americas Technology LLC, Carson City, NV (US)

(72) Inventor: James M. Sabo, Marysville, PA (US)

(73) Assignee: FCI Americas Technology LLC, Carson City, NV (US)

( * ) Notice: Subject to any disclaimer, the term of this patent is extended or adjusted under 35 U.S.C. 154(b) by 0 days.

(21) Appl. No.: 14/338,533

(22) Filed: Jul. 23, 2014

(65) Prior Publication Data

US 2015/0038002 A1 Feb. 5, 2015

Related U.S. Application Data

(60) Provisional application No. 61/861,838, filed on Aug. 2, 2013.

(51) Int. Cl.

| | |
|---|---|
| ***H01R 4/24*** | (2006.01) |
| *H01R 12/51* | (2011.01) |
| *H01R 12/57* | (2011.01) |

(52) U.S. Cl.

CPC ..... *H01R 4/2429* (2013.01); *H01R 4/2433* (2013.01); *H01R 12/515* (2013.01); *H01R 12/57* (2013.01)

(58) Field of Classification Search

CPC .... H01R 4/2404; H01R 4/2416; H01R 4/2429
USPC ..... 439/389, 391, 395, 404
See application file for complete search history.

(56) References Cited

U.S. PATENT DOCUMENTS

| | | | | |
|---|---|---|---|---|
| 3,845,455 | A * | 10/1974 | Shoemaker | H01R 4/2458 439/391 |
| 4,575,173 | A * | 3/1986 | Chapin | H01R 4/2466 439/398 |
| 5,022,868 | A | 6/1991 | Legrady | |
| 5,551,889 | A | 9/1996 | Kozel et al. | |
| 5,820,402 | A * | 10/1998 | Chiacchio | H01R 4/2462 439/398 |
| 6,979,222 | B2 * | 12/2005 | Comini | H01R 4/2458 439/395 |
| 7,011,543 | B2 * | 3/2006 | Hiramoto | H01R 4/2466 439/405 |
| 8,109,783 | B2 * | 2/2012 | Bishop | H01R 12/71 439/404 |

(Continued)

FOREIGN PATENT DOCUMENTS

WO WO 2012/123811 9/2012

*Primary Examiner* — Amy Cohen Johnson
*Assistant Examiner* — Matthew T Dzierzynski
(74) *Attorney, Agent, or Firm* — Wolf, Greenfield & Sacks, P.C.

(57) ABSTRACT

An insulation displacement contact includes a monolithic electrically conductive contact body that includes mating portion and a mounting portion. The mating portion defines a pair of insulation displacement slots configured to receive an electrical cable delivered by a connector housing. The insulation displacement contact includes a retention wall that is received by the connector housing in order to insert the electrical cable into the insulation displacement slots. The connector housing can further receive the insulation displacement contact so as to deliver the mounting portion to a complementary electrical component to which the insulation displacement contact is mounted.

20 Claims, 7 Drawing Sheets

(56) References Cited

U.S. PATENT DOCUMENTS

| | | | | |
|---|---|---|---|---|
| 8,740,638 | B2 * | 6/2014 | Lappoehn ..... | H01R 4/2433<br>439/397 |
| 2003/0171023 | A1 * | 9/2003 | Turek ..... | H01R 4/2454<br>439/395 |
| 2004/0185703 | A1 | 9/2004 | Lee | |
| 2011/0059632 | A1 | 3/2011 | Bishop | |
| 2011/0217866 | A1 | 9/2011 | Roosdorp et al. | |
| 2012/0003850 | A1 | 1/2012 | Bishop et al. | |
| 2012/0149233 | A1 * | 6/2012 | Hsueh ..... | H01R 13/112<br>439/395 |

* cited by examiner

INSULATION DISPLACEMENT CONNECTOR

CROSS-REFERENCE TO RELATED APPLICATIONS

This claims the priority to U.S. patent application Ser. No. 61/861,838 filed Aug. 2, 2013, the disclosure of which is hereby incorporated by reference as if set forth in its entirety herein.

BACKGROUND

Insulation displacement connectors (IDCs) are configured to electrically connect one or more electrical cables to a complementary electrical component, such as a printed circuit board. For instance, insulation displacement connectors include at least one insulation displacement contact having a mating portion configured to be mate with the complementary electrical component, and a cable piercing end that is configured to at least partially receive an electrical cable. Electrical cables typically include at least one electrically insulative layer and an electrical conductor that is disposed inside the electrically insulative layer. The insulation displacement contact of the insulation displacement connector is configured to pierce the outer layer of insulation of the electrical cable so as to make contact with the electrical conductor, thereby placing the electrical conductor in electrical communication with the complementary electrical component. Insulation displacement connectors can be desirable, as they allow for connection to an insulated cable without first stripping the electrical insulation from the conductor.

SUMMARY

In accordance with one embodiment, an insulation displacement contact includes a mounting portion that is configured to be mounted onto a complementary electrical component, the mounting portion defining first and second opposed ends spaced from each other along a longitudinal direction. The insulation displacement contact can further include a mating portion that extends out with respect to the mounting portion. The mating portion can include 1) a first arm that extends out from the first end of the mounting portion and toward the second end of the mounting portion, and 2) a second arm that extends out from the second end of the mounting portion and extends toward the first end of the mounting portion. The insulation displacement contact can further include at least one retention wall that extends from one of the first and second ends, the at least one retention wall configured to be received in a connector housing that is secured onto the insulation displacement contact. The first and second arms are spaced from each other so as to define first and second slots that are aligned with each other along the longitudinal direction and configured to receive an electrical cable. At least one of the the first and second arms includes at least one piercing member that at least partially defines the at least one of the slots, and is configured to pierce an outer electrically insulative layer of the electrical cable and contacts an electrical conductor of the electrical cable that is disposed inside the electrically insulative layer when the electrical cable is disposed in the at least one of the slots.

BRIEF DESCRIPTION OF THE DRAWINGS

The foregoing summary, as well as the following detailed description of example embodiments of the application, will be better understood when read in conjunction with the appended drawings, in which there is shown in the drawings example embodiments for the purposes of illustration. It should be understood, however, that the application is not limited to the precise arrangements and instrumentalities shown. In the drawings.

DETAILED DESCRIPTION

Figure 1A:
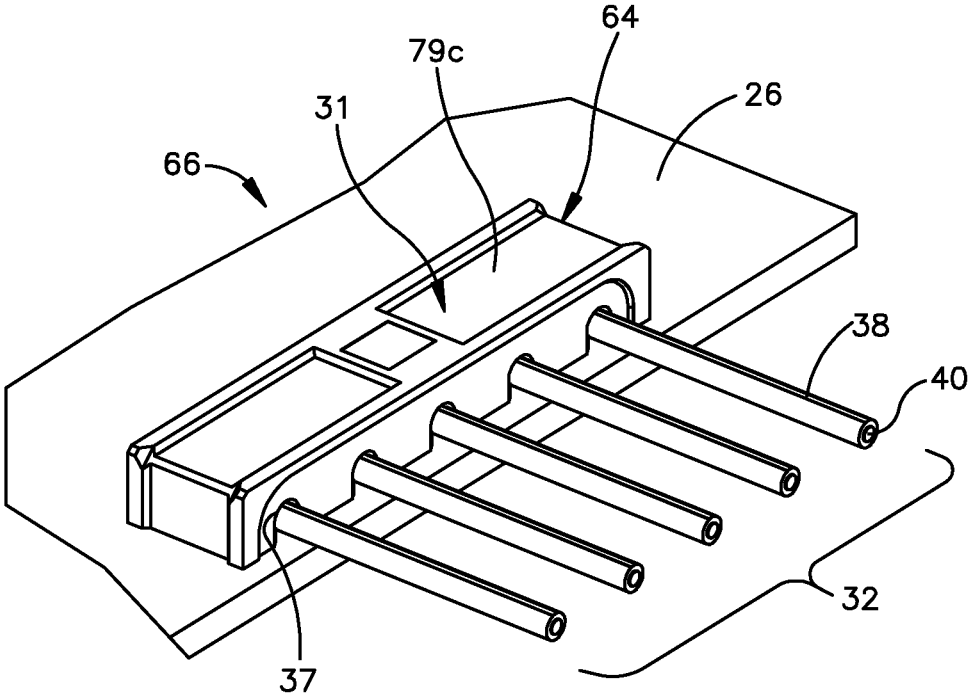
FIG. 1A is a perspective view of an electrical connector assembly, including a printed circuit board, a plurality of cables, a plurality of insulation displacement contacts configured to be mounted to the printed circuit board and mated to the cables, and a connector housing configured to retain the cables.
Figure 1B:
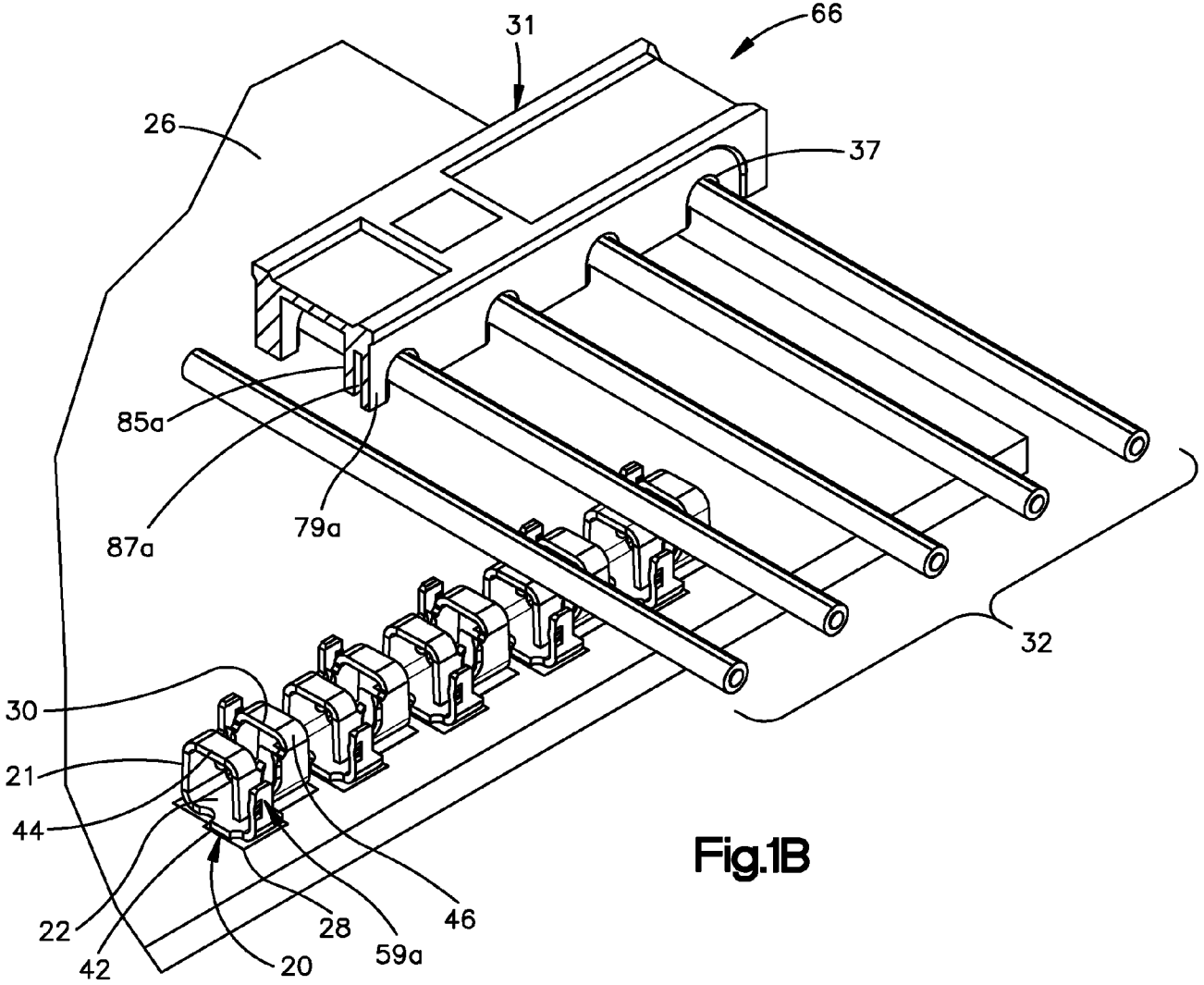
FIG. 1B is an exploded perspective view of the electrical connector assembly illustrated in FIG. 1A.
Figure 2A:
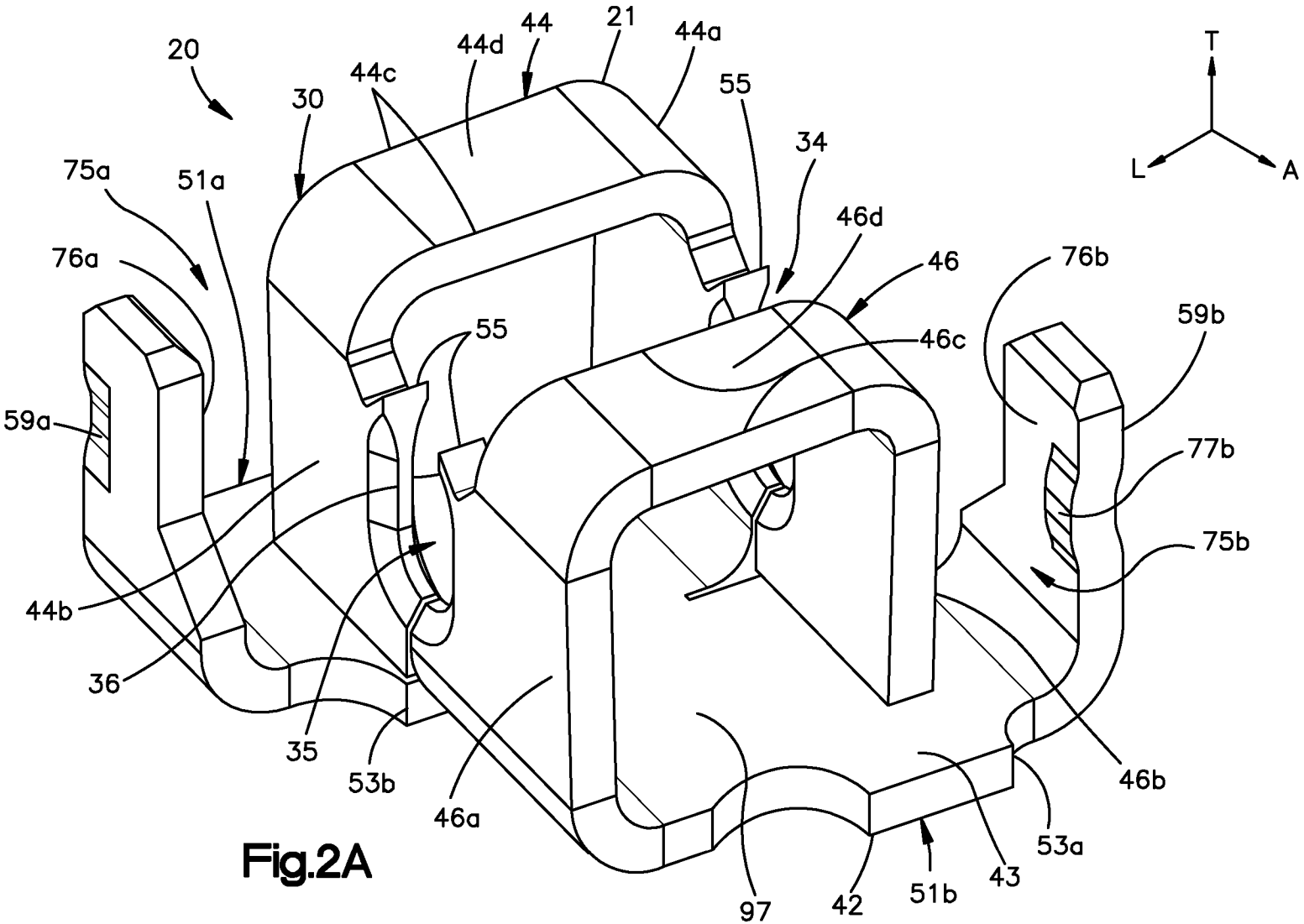
FIG. 2A is a perspective view of one of the insulation displacement contacts of the electrical connector assembly illustrated in FIG. 1A.
Figure 2B:
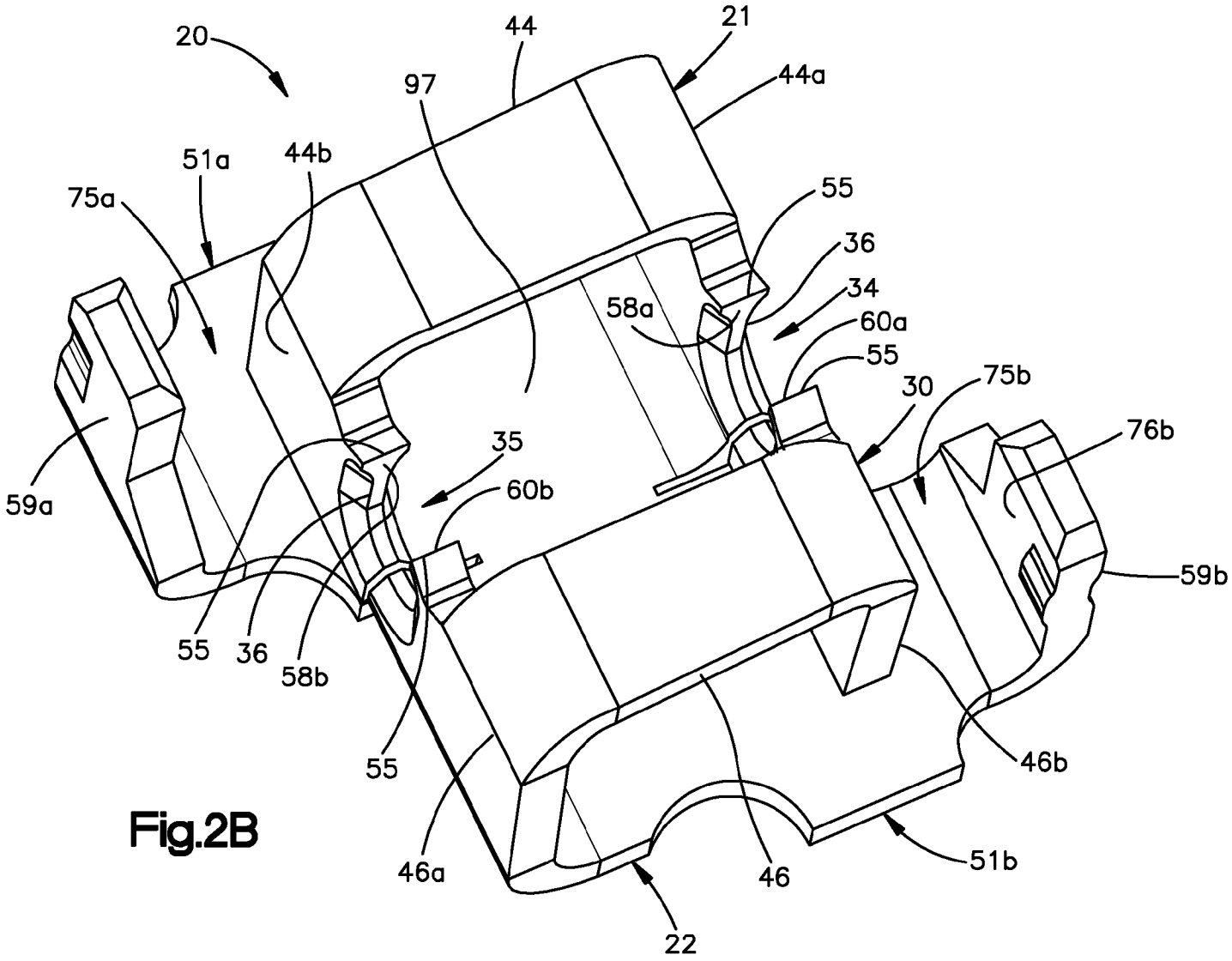
FIG. 2B is another perspective view of the insulation displacement contact illustrated in FIG. 2A.
Figure 2C:
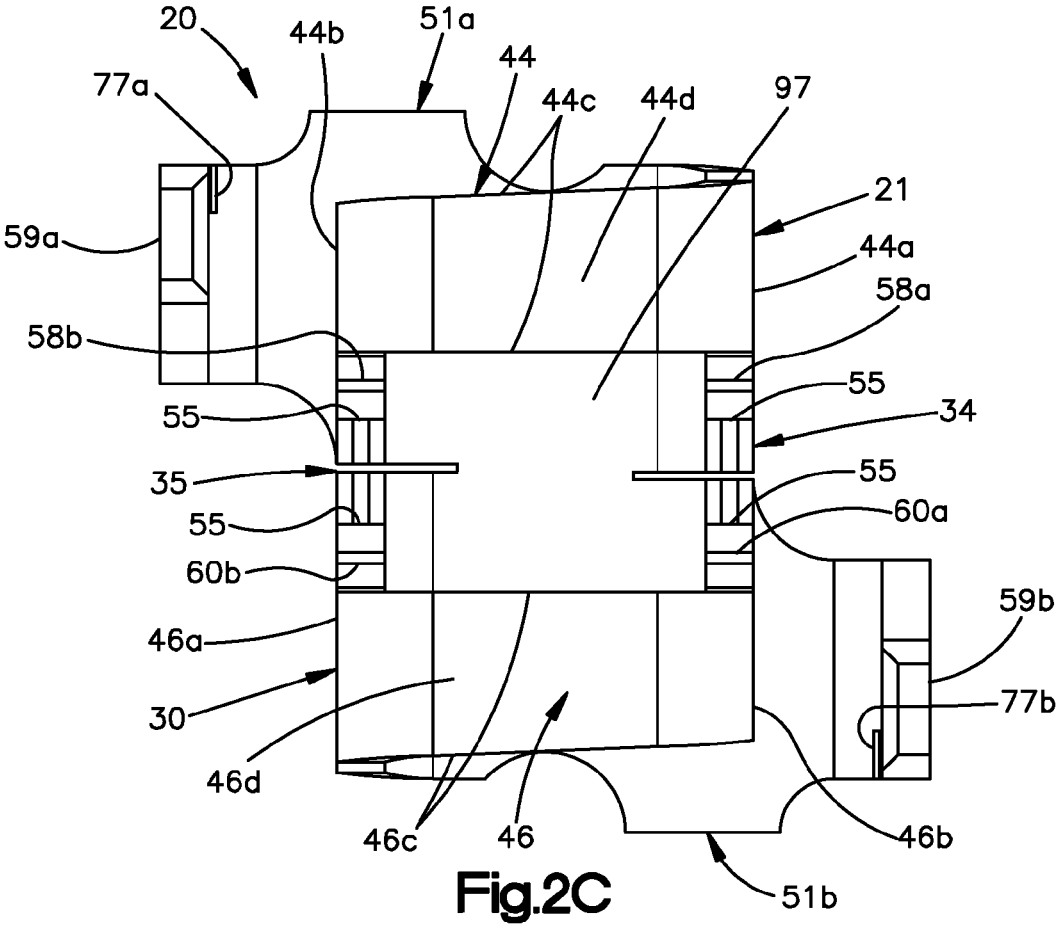
FIG. 2C is a top plan view of the insulation displacement contact illustrated in FIG. 2A.
Figure 2D:
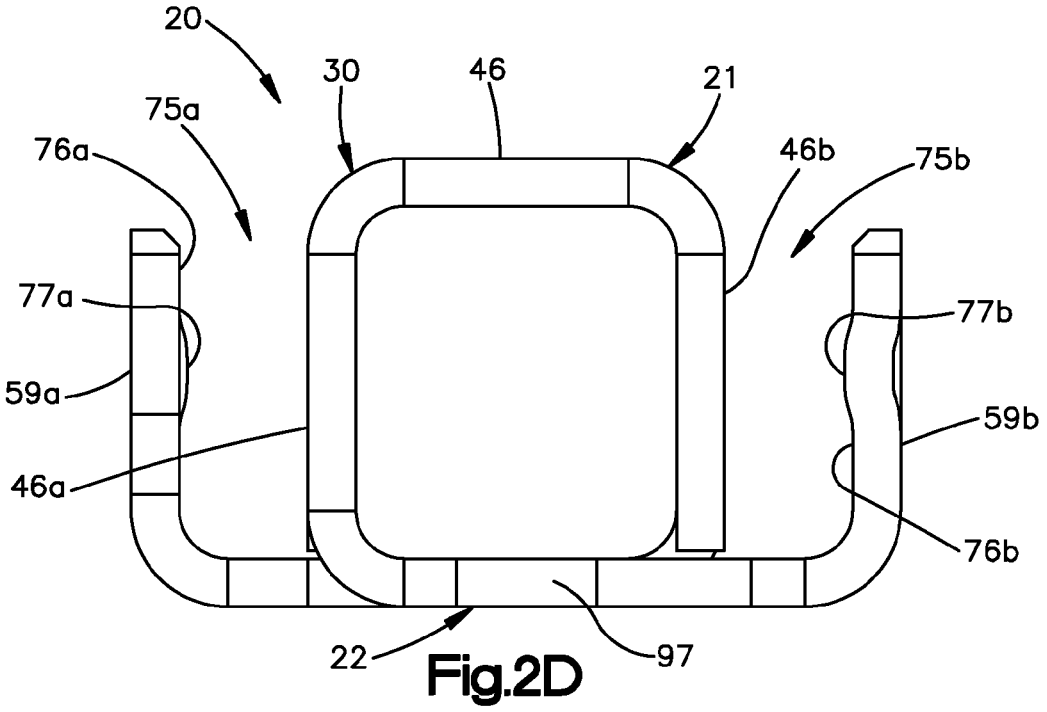
FIG. 2D is a side elevation view of the insulation displacement contact illustrated in FIG. 2A.

Referring to FIGS. 1A-1B, an insulation displacement connector 64 includes a connector housing 31 and at least one insulation displacement contact 20, such as a plurality of insulation displacement contacts 20. The connector housing 31 can be dielectric or electrically insulative. Each insulation displacement contact 20 has an electrically conductive contact body 21 that, in turn, includes a mounting portion 22 that is configured to be mounted onto a complementary electrical component 26. The complementary component 26 can be configured as a substrate, such as a printed circuit board, or can be any suitable alternative electrical component. The complementary electrical component 26 carries at least one electrical terminal 28. The mounting portion 22 can define a contact surface 42 that is configured to contact the electrical terminal 28 so as to mount the respective insulation displacement contact 20 to the complementary electrical component 26. For instance, the electrical terminal 28 of the printed circuit board can define a contact pad on an outer exposed surface of the complementary electrical component.

Thus, when the complementary electrical component 26 is configured as a printed circuit board, the mounting portion 22 can be surface mounted to the printed circuit board so as to contact the respective contact pad. For instance, the mounting portion 22 can be configured to be soldered, welded, or the like, onto the complementary electrical component 26, for instance to the electrical terminal 28. Alternatively or additionally, the mounting portion 22 can include a projection that is configured to be inserted into an aperture of the complementary electrical component 26. The projection can be press-fit into the aperture of the complementary electrical component 26, which can be an electrically conductive plated via.

The electrically conductive contact body 21 further includes a mating portion 30 that is configured to attach to an electrical cable 32 so as to mate the insulation displacement contact 20 to the electrical cable 32. The contact body 21 can be a one-piece monolithic structure that includes the mating portion 30 and the mounting portion 22. For instance, the contact body 21 can be configured as a stamped metal sheet that can be bent and formed to define the various components of the insulation displacement contact 20 as described herein. Accordingly, the mating portion 30 can be monolithic with the mounting portion 22. The insulation displacement contact 20, and all insulation displacement contacts described herein, can be made from metal or any alternative suitable electrically conductive material.

An electrical connector assembly 66 includes the insulation displacement connector 64, and at least one of the electrical cables 32 such as a plurality of the electrical cables 32. The electrical connector assembly 66 can further include the complementary electrical component 26. The mounting portion 22 is configured to be mounted onto the complementary electrical component 26 as described above, such that the complementary electrical component 26 is in electrical communication with the electrical cable 32. The connector housing 31 is configured to retain the electrical cables 32. The connector housing 31 is further configured to be placed over the insulation displacement contacts 20 that are mounted to the electrical component 26, such that the retained electrical cables 32 are inserted into the mating portion 30 so as to mate the insulation displacement contacts 20 with respective ones of the electrical cables 32.

Referring now also to FIG. 2A-2D, the mounting portion 22 can include a base 97 that defines an outer surface and an inner surface 43 that faces opposite the outer surface along a transverse direction T. Thus, reference herein to the mounting portion 22 can equally apply to the base 97 unless otherwise indicated. Further, reference herein to the base 97 can equally apply to the mounting portion 22 unless otherwise indicated. The outer surface is configured to face the electrical terminal, and defines the outer contact surface 42 that is configured to contact the electrical terminal 28. For instance, the outer contact surface 42 can be surface mounted, such as soldered or welded, to the electrical terminal 28. Alternatively, the base 97 can include mounting tails that extend from the outer surface and are configured to be inserted, for instance press-fit, into vias of the complementary electrical component 26. Thus, the mounting portion 22 can be defined by the base 97, and in particular the outer contact surface 42. When the outer contact surface 42 is in contact with the electrical terminal 28, either directly or indirectly, the electrical terminal 28 is placed in electrical communication with the mounting portion 22, and thus the mating portion 30. The outer contact surface 42 and the inner surface 43 can be spaced from each other along the transverse direction T. In particular, for the purposes of nomenclature, the inner surface 43 can be said to be spaced above, or up from, or in an upward direction from, the outer contact surface 42 along the transverse direction T. Similarly, the outer contact surface 42 can be said to be spaced below, or down from, or in a downward direction from, the inner surface 43 along the transverse direction T. The downward direction can be said to be opposite the upward direction.

The mounting portion 22, for instance the base 97, defines a first side portion 51*a* and a second side portion 51*b* that is disposed adjacent the first side portion 51*a* along a lateral direction A that is substantially perpendicular to the transverse direction T. As used herein, the phrase "substantially perpendicular" refers to a direction that is angularly offset, and in one example perpendicular, unless otherwise indicated. In accordance with one embodiment, the first and second side portions 51*a* and 51*b* can define equal halves of the base. Further, in accordance with one embodiment, the first and second side portions 51*a* and 51*b* can be symmetrical with respect to each other with respect to a combination of 1) a first divider line that extends along a longitudinal direction L and separates the first side portion 51*a* from the second side portion, and 2) a second divider line that extends along the lateral direction A and bifurcates the base 97. The longitudinal direction L is substantially perpendicular to each of the transverse direction T and the lateral direction A. The mounting portion 22, for instance the base 97, further defines a first end 53*a* and a second end 53*b* that is spaced from the first end 53*a* along the longitudinal direction L. The first end 53*a* can be defined by each of the first and second side portions 51*a* and 51*b*, and the second end 53*b* can similarly be defined by each of the first and second side portions 51*a* and 51*b*.

The mating portion 30 extends out with respect to the mounting portion 22. For instance, the mating portion 30 can extend out from the mounting portion 22. The contact body 21 can include a first arm 44 that extends out with respect to, for instance from, the first end 53*a* of the mounting portion 22 and toward the second end 53*b* of the mounting portion 22. The contact body 21 can further include a second arm 46 that extends out with respect to, for instance from, the second end 53*b* of the mounting portion 22 and extends toward the first end 53*a* of the mounting portion 22. For instance, in accordance with one embodiment, the first arm 44 can extend out from the first end 53*a* of the base 97 at the first side portion 51*a*, and the second arm 46 can extend out from the second end 53*b* of the base 97 at the second side portion 51*b*.

In accordance with one embodiment, the first end 53*a* at the second side portion 51*b* can be disposed outward with respect to the first end 53*a* at the first side portion 51*a* along the longitudinal direction L. Similarly, the second end 53*b* at the first side portion 51*a* can be disposed outward with respect to the second end 53*b* of the second side portion 51*b* along the longitudinal direction L. The mounting portion 22 can define a midline that extends along the lateral direction A and bifurcates the base 97 into two equal halves along the longitudinal direction L. The first end 53*a* at the first side portion 51*a* is spaced a first distance from the midline along the longitudinal direction L, and the second and 53*b* at the second side portion 51*b* is spaced from the midline the same first distance along the longitudinal direction L. The first end 53*a* at the second side portion 51*b* is spaced a second distance from the midline along the longitudinal direction L, and the second and 53*b* at the first side portion 51*a* is spaced from the midline the same second distance along the longitudinal direction L. The second distance is greater than the first distance.

The first and second arms 44 and 46 can be spaced from each other, for instance along the lateral direction A, so as to define first and second insulation displacement slots 34 and 35 that are spaced from each other and aligned with each other along a longitudinal direction L. For instance, the first and second arms 44 and 46 combine so as to define the first insulation displacement slot 34. The first and second arms 44 and 46 further combine so as to define the second insulation displacement slot 35. At least one or both of the first and second arms 44 and 46 includes at least one piercing member 36 that at least partially defines at least one or both of the slots 34 and 35. For instance, the first arm 44 can define a first piercing member 36 that partially defines the first insulation displacement slot 34. The first arm 44 can further define a second piercing member 36 that partially defines the second insulation displacement slot 35. Similarly, the second arm 46 can define a first piercing member 36 that partially defines the first insulation displacement slot 34. The second arm 46 can further define a second piercing member 36 that partially defines the second insulation displacement slot 35. When the at least one or both of the slots 34 and 35 receives the electrical cable 32, the piercing member 36 pierces an outer electrically insulative layer 38 of the electrical cable 32 and contacts an electrical conductor 40 of the electrical cable 32 that is disposed inside the outer electrically insulative layer 38.

Each of the first and second arms 44 and 46 defines a respective proximal portion 44*a* and 46*a* that extends from the mounting portion 22. For instance, the first proximal portion 44*a* extends from the first end 53*a* at the first side portion 51*a* of the mounting portion 22. The second proximal portion 46*a* extends from the second end 53*b* of the second side portion 51*b* of the mounting portion 22. The mounting portion 22 can be configured as a plate that can be substantially planar along the longitudinal direction and the lateral direction A, or alternatively shaped as desired. The first arm 44 can further define a distal portion 44*b* opposite the first proximal portion 44*a* with respect to the longitudinal direction L. Similarly, the second arm 46 can define a distal portion 46*b* opposite the second proximal 46*a* with respect to the longitudinal direction L. The distal portions 44*b* and 46*b* are free from attachment to the mounting portion 22. Thus, the first and second arms 44 and 46 are cantilevered from the respective proximal ends 44*a* and 46*a* over the mounting portion 22 along the transverse direction T.

The proximal portion 44*a* of the first arm 44 defines a first inner surface 58*a*, and the distal portion 46*b* of the second arm 46 defines a second inner surface 60*a* that is opposite the first inner surface 58*a*, for instance along the lateral direction A, so as to define the first slot 34. At least one or both of the first and second inner surfaces 58*a* and 60*a* defines the piercing member 36. The distal portion 44*b* of the first arm 44 defines a third inner surface 58*b*, and the proximal portion 46*a* of the second arm 46 defines a fourth inner surface 60*b* that is opposite the third inner surface 58*b*, for instance along the lateral direction A, so as to define the second slot 35. At least one or both of the third and fourth inner surfaces 58*b* and 60*b* defines the piercing member 36. Each of the first and second slots 34 and 35 defines an open end that faces up along the transverse direction T away from the mounting portion 22, and the complementary electrical component 26 to which the mounting portion 22 is mounted, so as to define an insertion direction into the slots in a downward direction along the transverse direction T, and thus toward the mounting portion 22 and the complementary electrical component 26. Thus, each of the first and second slots 34 and 35 has an open first end, and can have a closed second end that is spaced from the open first end in the insertion direction.

At least a portion of at least one or both of the first and second arms 44 and 46 is tapered inwardly along a direction from the respective proximal portion 44*a* and 46*a* toward the respective distal portion 44*b* and 46*b*, respectively. For instance, each of the first and second arms 44 and 46 defines opposed sides 44*c* and 46*c*, respectively, that are spaced from each other along the lateral direction A. The sides 44*c* can converge toward each other in a direction along the first arm 44 from the proximal portion 44*a* toward the distal portion. Similarly, the sides 46*c* can converge toward each other in a direction along the second arm 46 from the proximal portion 46*a* toward the distal portion 46*b*. For instance, the first arm 44 includes a first bridge 44*d* that extends between the proximal portion 44*a* and the distal portion 44*b*. Similarly, the second arm 46 includes a second bridge 46*d* that extends between the proximal portion 46*a* and the distal portion 46*b*. The first and second bridges 44*d* and 46*d* can be spaced above the mounting portion 22 along the transverse direction. The first bridge 44*d* can be tapered inwardly in the lateral direction A along a direction from the proximal portion 44*a* toward the distal portion 44*b*. For instance, the first bridge 44*d* can be tapered inwardly in the lateral direction A from the proximal portion 44*a* to the distal portion 44*b*. Similarly, the second bridge 46*d* can be tapered inwardly in the lateral direction A along a direction from the proximal portion 46*a* toward the distal portion 46*b*. For instance, the second bridge 46*d* can be tapered inwardly in the lateral direction A from the proximal portion 46*a* to the distal portion 46*b*. In accordance with the illustrated embodiment, the respective opposed sides 44*c* converge toward each other such that the respective first bridge 44*d* tapers inwardly between the respective proximal and distal portions 44*a* and 44*b* in a direction from the respective proximal portion 44*a* toward the respective distal portion 44*b*, for instance from the respective proximal portion 44*a* toward the respective distal portion 44*b*. Similarly, in accordance with the illustrated embodiment, the respective opposed sides 46*c* converge toward each other such that the respective second bridge 46*d* tapers inwardly between the respective proximal and distal portions 46*a* and 46*b* in a direction along a direction from the respective proximal portion 46*a* toward the respective distal portion 46*b*, for instance from the respective proximal portion 46*a* toward the respective distal portion 46*b*. Each of the first and second arms 44 and 46 are elongate along respective central axes that are substantially parallel to each other as they extend along the proximal portions 44*a* and 46*a*, along the respective bridges 44*d* and 46*d*, and along the distal portions 44*b* and 46*b*.

As described above, the proximal portion 44*a* of the first arm 44 and the distal portion 46*b* of the second arm 46 define the first slot 34, and the distal portion 44*b* of the first arm 44 and the proximal portion 46*a* of the second arm 46 define the second slot 35. The distal portions 44*b* and 46*b* that at least partially define the first and second slots 34 and 35, respectively, are configured to deflect away from the corresponding proximal portion 46*a* and 44*a* at the respective first and second slots 34 and 35 when the electrical cable 32 is inserted into the first and second slots 34 and 35 along the insertion direction. For instance, the electrical cable 32 defines an outer cross-sectional dimension in the lateral direction A when inserted in the slots 34 and 35 that is greater than a distance between the portions of the arms 44 and 46 that define the respective slots. Accordingly, the electrical cable 32 biases the distal portions to deflect away from the proximal portions. The outer cross-sectional dimension of the electrical cable can be a diameter. It should be appreciated that the first and second inner surfaces 58*a* and 60*a* can abut each other prior to insertion of the electrical cable 32 in the first slot 34. Alternatively, the first and second inner surfaces 58*a* and 60*a* can be spaced from each other in the lateral direction prior to insertion of the electrical cable 32 in the first slot 34. Similarly, the third and fourth inner surfaces 58*b* and 60*b* can abut each other prior to insertion of the electrical cable 32 in the second slot 35. Alternatively, the third and fourth inner surfaces 58*b* and 60*b* can be spaced from each other in the lateral direction A prior to insertion of the electrical cable 32 in the second slot 35.

Thus, the third inner surface 58*b* is configured to deflect away from the fourth inner surface 60*b* as the electrical cable 32 is inserted into the first insulation displacement slot 34 along the insertion direction. For example, in accordance with one embodiment, the distal portion 44*b* rotates, with respect to the proximal portion 44*a* as the electrical cable 32 is inserted into the first insulation displacement slot 34 along the insertion direction. Thus, the third inner surface 58*b*, which is defined by the distal portion 44*b*, displaces angularly, for instance rotates, with respect to the first inner surface 58*a*, which is defined by the proximal portion 44*a*, in a first angular direction when the electrical cable 32 is inserted into the first insulation displacement slot 34. Similarly, the second inner surface 60*a* is configured to deflect away from the first inner surface 58*a* as the electrical cable 32 is inserted into the second insulation displacement slot 35 along the insertion direction. For example, in accordance with one embodiment, the distal portion 46*b* rotates, with respect to the proximal portion 46*a* as the electrical cable 32 is inserted into the second insulation displacement slot 35 along the insertion direction. Thus, the second inner surface 60*a*, which is defined by the distal portion 46*b*, displaces angularly, for instance rotates, with respect to the fourth inner surface 60*b*, which is defined by the proximal portion 46*a*, in a second angular direction when the electrical cable 32 is inserted into the second insulation displacement slot 35. The second angular direction is opposite the first angular direction. After angular displacement of the second and third inner surfaces 60*a* and 58*b*, a midline of the first insulation displacement slot 34 that is equidistantly spaced from the inner surfaces that define the first insulation displacement slot 34 is offset, for instance angularly offset and offset along the lateral direction A, from a midline of the second insulation displacement slot 35 that is equidistantly spaced from the inner surfaces that define the second insulation displacement slot 35.

Figure 2E:
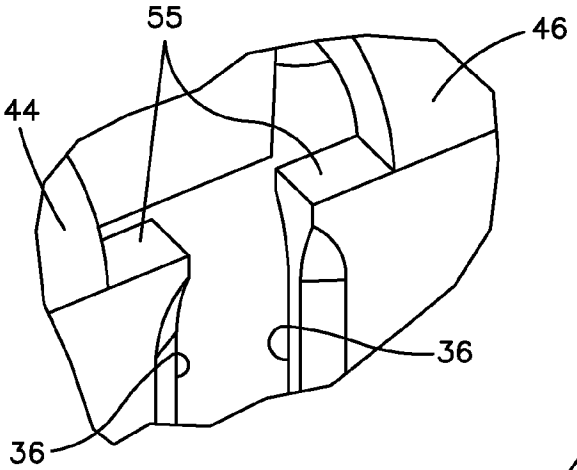
FIG. 2E is an enlarged perspective view of a portion of the insulation displacement contact illustrated in FIG. 2A, but constructed in accordance with an alternative embodiment.

At least one or more up to all of the inner surfaces 58*a-b* and 60*a-b* can define a respective shoulder 55 that projects toward the opposed inner surface of the respective slot. A distance between the shoulder 55 and the opposed inner surface along the lateral direction is less than the outer cross-sectional dimension of the electrical cable 32, which can be defined by the outer cross-sectional dimension, for instance diameter, of the outer electrically insulative layer 38. Thus, the shoulders 55 are configured to remove a portion of the outer electrically insulative layer 38 from the electrical conductor 40 as the electrical cable 32 is inserted into the respective insulation displacement slots 34 and 35 along the insertion direction. The shoulders 55 can be tapered so as to define a thickness in the longitudinal direction L that decreases along the insertion direction to the respective inner surfaces 58*a-b* and 60*a-b*. One or more up to all of the shoulders 55 can be substantially V-shaped, including substantially U-shaped, W-shaped, M-shaped, or alternatively shaped as desired so as to define at least one angled or rounded vertex, from a view to the respective inner surface along the longitudinal direction L. Alternatively, one or more up to all of the shoulders 55 can be substantially L-shaped from a view to the respective shoulder 55 along the longitudinal direction L (see FIG. 2E). Each of the first and second insulation displacement slots 34 and 34 can be substantially U-shaped, including V-shaped so as to define at least one vertex which can be angled, rounded, or otherwise shaped at its closed end, from a view to the slots 34 and 35 along the longitudinal direction L.

As described above, the insulation displacement connector 64 can include at least one insulation displacement contact 20, such as a plurality of the insulation displacement contacts 20, and the connector housing 31. The insulation displacement contact 20 can further include at least one retention wall that is configured to apply a retention force against the connector housing 31 so as to retain the connector housing 31 in juxtaposition with the insulation displacement contact 20 when the connector housing 31 is secured onto the insulation displacement contact 20. For instance, the insulation displacement contact 20 can include a first retention wall 59*a* that extends from the second end 53*b* and a second retention wall 59*b* that extends from the first end 53*a*. The first retention wall 59*a* can be aligned with the first arm 44 along the longitudinal direction L. Similarly, the second retention wall 59*b* can be aligned with the second arm 46 along the longitudinal direction L.

Each of the first and second retention walls 59*a* and 59*b* is configured to apply a retention force against the connector housing 31 so as to retain the connector housing 31 in juxtaposition with the insulation displacement contact 20 when the connector housing 31 is secured onto the insulation displacement contact 20. For instance, the first retention wall 59*a* can extend from the first side portion 51*a*, for instance from the second end 53*b* of the first side portion 51*a*, and the second retention wall 59*b* can extend from the second side portion 51*b*, for instance from the first end 53*a* of the second side portion 51*b*. Thus, the first retention wall 59*a* is spaced along the longitudinal direction L from the distal portion 44*b* of the first arm 44. A portion of the first retention wall 59*a* can be further offset along the lateral direction A with respect to the distal portion 44*b* of the first arm 44. Similarly, the second retention wall 59*b* is spaced along the longitudinal direction L from the distal portion 46*b* of the second arm 46. A portion of the second retention wall 59*b* can be offset along the lateral direction A with respect to the distal portion 46*b* of the second arm 46. Each of the first and second retention walls 59*a* and 59*b* can extend up from the base 97. For instance, each of the first and second retention walls can extend from the base 97 along the transverse direction T. The first and second retention walls 59*a* and 59*b* can be monolithic with the base 97, the first arm 44, and the second arm 46.

The first retention wall 59*a* defines a first inner surface 76*a* that faces a corresponding outer surface of the distal portion 44*b* of the first arm 44 so as to define a first retention gap 75*a* that extends from the distal portion 44*b* to the first retention wall 59*a*. Because at least a portion of the first retention wall 59*a* can be offset with respect to the distal portion 44*b* along the lateral direction A, the first gap 75*a* can extend from a first plane that includes the outer surface of the first arm 44, for instance at the distal portion 44*b*, to a second plane that includes the first inner surface 76*a* along the longitudinal direction L. Thus, the first retention gap 75*a* can be further defined from the outer surface of the first arm 44 to the first inner surface 76*a*. The first retention gap 75*a* is sized to receive and capture a first portion of the connector housing 31 when the connector housing 31 is secured onto the insulation displacement contact 20.

Similarly, the second retention wall 59*b* defines a second inner surface 76*b* that faces a corresponding outer surface of the second arm 46 so as to define a second retention gap 75*b* that extends from the distal portion 46*b* to the second retention wall 59*b*. Because at least a portion of the second retention wall 59*b* can be offset with respect to the distal portion 46*b* along the lateral direction A, the second gap 75*b* can extend from a third plane that includes the outer surface of the second arm 46, for instance at the distal portion 46*b*, to a fourth plane that includes the second inner surface 76*b* along the longitudinal direction. Thus, the second retention gap 75*b* can be further defined from the outer surface of the second arm 46 to the second inner surface 76*b*. The second retention gap 75*b* is sized to receive and capture a second portion of the connector housing 31, that is spaced from the first portion of the connector housing 31, when the connector housing 31 is secured onto the insulation displacement contact 20. In accordance with one embodiment, each of the first and second retention walls 59*a* and 59*b* is spaced from the base 97 no further along the transverse direction T than the bridges 44*d* and 46*d* of the first and second arms, respectively, are spaced from the base 97 along the transverse direction T. Further, each of the first and second retention walls 59*a* and 59*b* can be configured to be received in a retention gap of the connector housing 31 when the connector housing 31 is secured onto the insulation displacement contact 20.

In accordance with one embodiment, the insulation displacement contact 20 can include at least one dimple that at least partially defines at least one of the first and second retention gaps 75*a* and 75*b*, such that the at least one of the first and second retention gaps 75*a* and 75*b* defines a region of reduced length along the longitudinal direction L at a location aligned with the at least one dimple. For instance, the insulation displacement contact 20 can include at least one dimple, such as a first dimple 77*a*, that at least partially defines the first retention gap 75*a*. Thus, the first retention gap 75*a* defines a first length along the longitudinal direction L in alignment with the first dimple 77*a*, and a second length along the longitudinal direction L from the first retention wall 59*a* to the first arm 44 at a location spaced from the first dimple 77*a*, such that the first length is less than the second length. For example, the first dimple 77*a* can extend from the first inner surface 76*a* of the first retention wall 59*a* toward the first arm 44, such as the distal portion 44*b* of the first arm 44. At least a portion, such as a majority, of the first retention wall 59*a* can be aligned with the first arm 44, and in particular the distal portion 44*b* of the first arm 44, along the longitudinal direction L. The first dimple 77*a* can be aligned with the distal portion 44*b* of the first arm 44 along the longitudinal direction L, or can be offset from the distal portion 44*b* of the first arm 44 along the lateral direction A, but aligned with the first plane. The first dimple is configured to contact the first portion of the connector housing 31 when the connector housing 31 is secured onto the insulation displacement contact 20. Thus, the first dimple 77*a* can provide a frictional retention force against the connector housing 31 so as to capture the first portion of the connector housing 31 in the first retention gap 75*a*, though it should be appreciated that the first dimple 77*a* can alternatively interlock with the connector housing 31, or engage the connector housing 31 in any alternative manner, directly or indirectly, so as to capture the first portion of connector housing 31.

Similarly, the insulation displacement contact 20 can include at least one dimple, such as a second dimple 77*b*, that at least partially defines the second retention gap 75*b*. Thus, the second retention gap 75*b* defines a third length along the longitudinal direction L in alignment with the second dimple 77*b*, and a fourth length along the longitudinal direction L from the second retention wall 59*b* to the second arm 46 at a location spaced from the second dimple 77*b*, such that the third length is less than the fourth length. For example, the second dimple 77*b* can extend from the second inner surface 76*b* of the second retention wall 59*b* toward the second arm 46, such as the distal portion 46*a* of the second arm 46. At least a portion, such as a majority, of the second retention wall 59*b* can be aligned with the first arm 44, and in particular the distal portion 46*b* of the second arm 46, along the longitudinal direction L. The second dimple 77*b* can be aligned with the distal portion 46*b* of the second arm 46 along the longitudinal direction L. Alternatively, the second dimple 77*b* can be offset from the distal portion 46*b* along the lateral direction A and aligned with the third plane along the longitudinal direction. The second dimple 77*b* is configured to contact the second portion of the connector housing 31 when the connector housing 31 is secured onto the insulation displacement contact 20. Thus, the second dimple 77*b* can provide a frictional retention force against the connector housing 31 so as to capture the second portion of the connector housing 31 in the second retention gap 75*b*, though it should be appreciated that the second dimple 77*b* can alternatively interlock with the connector housing 31, or engage the connector housing 31 in any alternative manner, directly or indirectly, so as to capture the second portion of connector housing 31.

The third length can equal the first length or can be different than the first length, and the fourth length can be equal to the second length or can be different than the second length. Thus, each of the first and second dimples 77*a* and 77*b* is configured to contact the connector housing 31 so provide a retention force against the connector housing 31 that assists in retaining the connector housing 31 with respect to the insulation displacement contact 20 when the connector housing 31 is mounted to the insulation displacement contact 20. Thus, the first and second dimples 77*a* and 77*b* contact the first and second portions, respectively, of the connector housing 31 when the first and second portions of the connector housing 31 are captured in the first and second retention gaps 75*a* and 75*b*, respectively.

Figure 3:
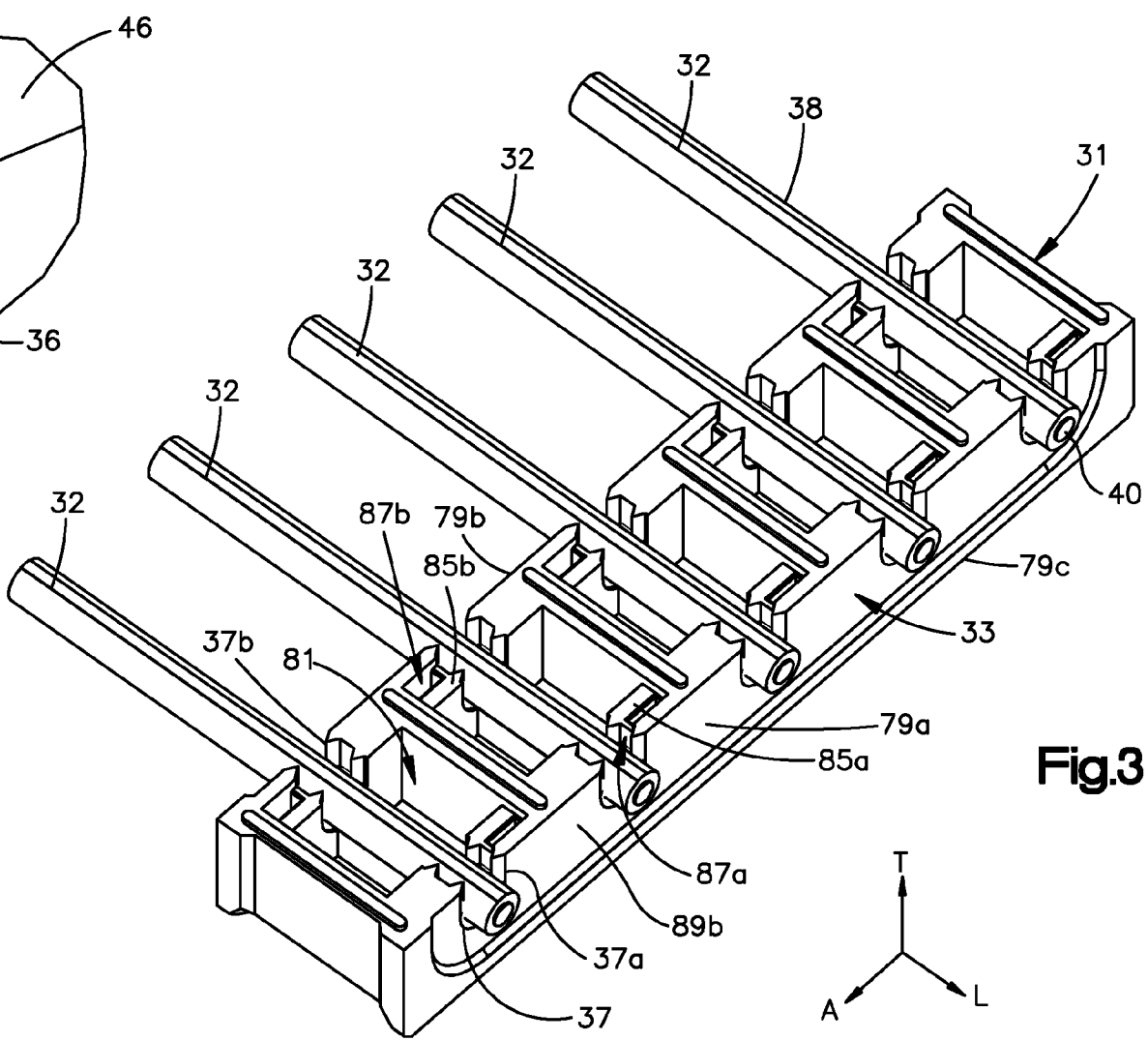
FIG. 3 is an exploded perspective view of the cables retained by the connector housing as illustrated in FIG. 1B prior to being mated with the insulation displacement contacts.
Figure 4A:
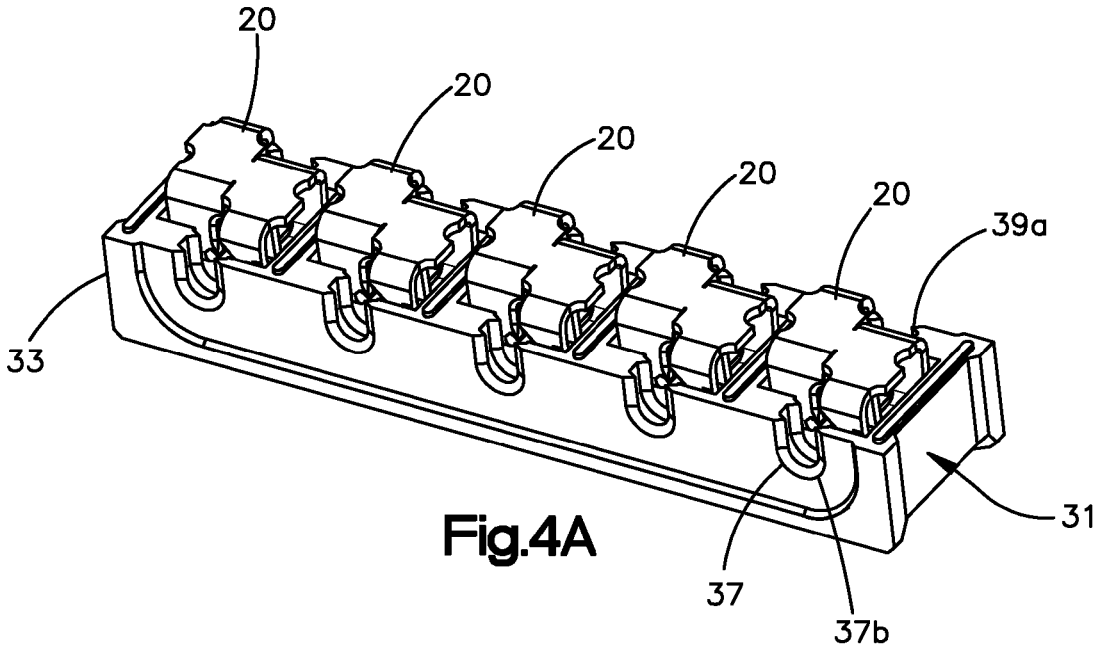
FIG. 4A is a perspective view showing the insulation displacement contacts of the electrical connector assembly retained by the connector housing.
Figure 4B:
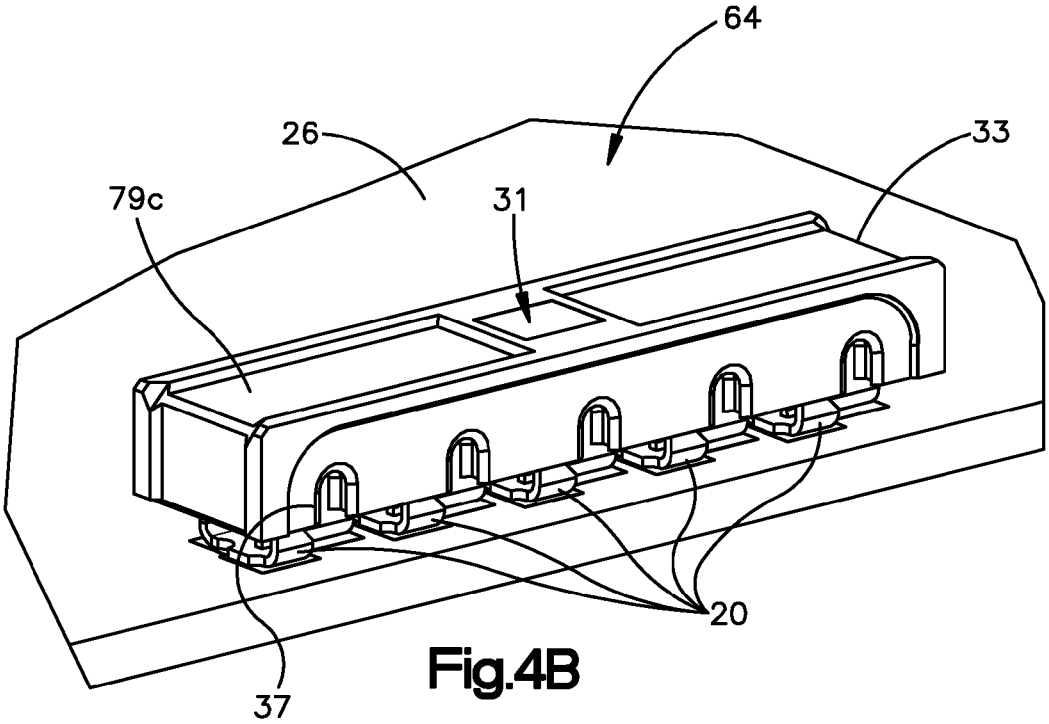
FIG. 4B is a perspective view showing placement of the insulation displacement contacts illustrated in FIG. 4A onto the printed circuit board so as to mount the insulation displacement contacts to the printed circuit board.

Referring now also to FIGS. 3-4B, the connector housing 31 can be electrically insulative. The connector housing 31 includes a housing body 33 and at least one cable retention channel 37, such as a plurality of cable retention channels 37, that extends at least into or through the housing body 33 along the longitudinal direction L. The cable retention channels 37 are configured to receive and retain the electrical cable 32. The housing body 33 is configured to move relative to the insulation displacement contact or contacts 20 along the insertion direction such that the retained electrical cable or cables 32 are inserted into the first and second insulation displacement slots 34 and 35 of the respective insulation displacement contact or contacts 20. In accordance with one embodiment, the housing body 33 can include first and second end walls 79*a* and 79*b*, respectively, that are spaced from each other along the longitudinal direction L. The housing body 33 can further include a top wall 79*c*, such that the first and second end walls 79*a* and 79*b* extend out from the top wall 79*c* along the transverse direction T. The connector housing 31 can further define least one opening 81 that extends into the housing body 33 between the first and second housing end walls 79*a* and 79*b*. Thus, the cable retention channel 37 can be defined by the first housing end wall 79*a*, the second housing end wall 79*b*, and the at least one opening 81. The connector housing 31 is sized such that an entirety of the insulation displacement contact 20 can be disposed between the first and second housing end walls 79*a* and 79*b* when the connector housing 31 is secured onto the insulation displacement contact 20. A portion of the insulation displacement contact 20 can extend down with respect to the housing body 33 along the transverse direction T when the insulation displacement contact 20 is disposed in the cable retention channel 37.

The connector housing 31 can further include at least one retention wall that is configured to be received in the at least one retention gap of the insulation displacement contact 20. For instance, the connector housing 31 can include a first retention wall 85*a* that is configured to be received in the first retention gap 75*a* of the insulation displacement contact 20, and a second retention wall 85*b* that is configured to be received in the second retention gap 75*b* of the insulation displacement contact 20. The first retention wall 85*a* is spaced from the first end wall 79*a* along the longitudinal direction L so as to define a first retention gap 87*a* that is configured to receive the first retention wall 59*a* of the insulation displacement contact 20. Similarly, the second retention wall 85*b* is spaced from the second end wall 79*b* along the longitudinal direction L so as to define a second retention gap 87*b* that is configured to receive the second retention wall 59*b* of the insulation displacement contact 20. The first and second retention walls 85*a* and 85*b* are disposed between the first and second end walls 79*a* and 79*b* along the longitudinal direction L. An entirety of each of the first and second arms 44 and 46 can be disposed between the first and second retention walls 85*a* and 85*b* when the connector housing 31 is secured onto the insulation displacement contact 20. Further, the first housing retention wall 85*a* and the first housing end wall 79*a* can define a first end 37*a* of one of the cable retention channels 37, and the second housing retention wall 85*b* and the second end wall 79*b* can define a second end 37*b* of the one of the cable retention channels 37. The first and second ends 37*a* and 37*b* of the cable retention channel 37 can be in alignment with each other along the longitudinal direction L.

During operation, the opening 81 is configured to receive the first and second arms 44 and 46 of the insulation displacement contacts 20, and the retention gaps 87*a* and 87*b* are configured to receive the first and second retention walls 59*a* and 59*b*, respectively. Thus, as illustrated in FIG. 1B, after the insulation displacement contacts 20 have been mounted on to the complementary electrical component 26 in the manner described above, and the electrical cables 32 are retained by the connector housing 31, the connector housing 31 is moved in the insertion direction relative to the insulation displacement contacts 20 so as to insert the retained electrical cables 32 into the respective first and second slots 34 and 35, thereby mating the insulation displacement contacts 20 to respective ones of the electrical cables 32 retained by the connector housing 31, and establishing an electrical connection between the insulation displacement contacts 20 and respective ones of the retained electrical cables. At least a portion of the cable retention channels 37 at the respective perimeters can be open, for instance out the connector housing 31 at a location that faces the mounting portion 22 and is configured to face the complementary electrical component 26. Thus, once the insulation displacement contacts 20 have been mated with the respective electrical cables 32, the connector housing 31 can be moved away from the insulation displacement contacts 20 in a removal direction opposite the insertion direction, such that the cables 32 are removed from the connector housing 31 out the open portion of a perimeter of the cable retention channel 37. The cables 32 can remain in the slots 34 and 35 of the mating portion 22 as the connector housing 31 is removed.

An electrical connector assembly 66 includes one or more of the insulation displacement contacts 20 or the insulation displacement connector 64, at least one such as a plurality of the electrical cables 32, and the complementary electrical component 26. The mounting portion 22 is configured to be mounted onto the complementary electrical component 26, such that the complementary electrical component 26 is in electrical communication with the electrical conductor 40 when the electrical cables 32 are attached to the insulation displacement contacts 20. The assembly 66 can further include the connector housing, wherein the electrical cables 32 extend at least into the cable retention channel 37. The cables 32 can extend out the first end wall 79*a* or out the second end wall 79*b*, depending on the orientation of the connector housing 31.

Referring now to FIGS. 4A-4B, a method of assembling the electrical connector assembly 66 can include the steps of mounting the connector housing 31 onto a plurality of the insulation displacement contacts 20, such that interference between the connector housing 31 and at least one or more, such as all, of the plurality of insulation displacement contacts 20 retains the connector housing 31 on the plurality of insulation displacement contacts 20. The method can further include the step of placing the plurality of insulation displacement contacts 20, for instance the mounting portion of the insulation displacement contacts 20, against the complementary electrical component 26 while the insulation displacement contacts 20 are supported by the connector housing 31. For instance, the placing step can include the step of grasping the connector housing 31 and moving the connector housing 31 so as to place plurality of insulation displacement contacts 20 against the complementary electrical component 26. Next, the method can include the step of securing the mounting portion of the insulation displacement contacts 20 to the complementary electrical component 26. For instance, the securing step can include the step of soldering the insulation displacement contacts 20 to respective terminals of the complementary electrical component 26. After the securing step, the method can include the step of removing the connector housing 31 from the plurality of insulation displacement contacts 20, such that the insulation displacement contacts remain secured to the complementary electrical component 26. The method can further include the step of placing a plurality of electrical cables 32 into corresponding ones of the plurality of cable retention channels 37. For instance, the electrical cables 32 can be placed in respective ones of the cable retention channels 37. The cable retention channels 37 can be necked, for instance at the first and second end walls, the first and second retention walls, or both, such that the electrical cables 32 are captured in the cable retention channels 37. Next, the method can include the step of bringing the connector housing 31 down onto the insulation displacement contacts 20 such that the electrical cables 32 are inserted into the first and second insulation displacement slots 34 and 35 of respective ones of the insulation displacement contacts 20.

Referring now to FIGS. 1-4B in general, a method can be further provided for placing the electrical cable 32 in electrical communication with the complementary electrical component 26. The method can include the steps of placing the mounting portion 22 in electrical communication with the complementary electrical component 26, and inserting the electrical cable 32 into both of a pair of slots 34 and 35 that are defined by and between 1) the first arm 44 that extends out from the first end of the mounting portion 22 and toward the second end of the mounting portion 22, and 2) the second arm 46 that extends out from the second end of the mounting portion 22 and extends toward the first end of the mounting portion 22. The method can further include the step of piercing with the piercing member 36 the outer electrically insulative layer 38 of the electrical cable 32 and contacting the electrical conductor 40 of the electrical cable 32 that is disposed inside the electrically insulative layer 38. The piercing member 36 can be defined by at least one or both of the first and second arms 44 and 46, and can at least partially define at least one or both of the first and second slots 34 and 35. The inserting step can cause the piercing step. The placing step can be performed before or after the inserting step. The electrical cable 32 can extend at least into or through the connector housing 31, and the inserting step can further include placing the connector housing 31 adjacent the insulation displacement contact 20.

The inserting step can further include receiving the insulation displacement contact 20 in the connector housing 31. Each of the first and second arms 44 and 46 can include a piercing member 36 that at least partially defines each of the first and second slots 34 and 35, respectively, and the piercing step can further include piercing with each of the piercing members 36 the outer electrically insulative layer 38 and contacting the electrical conductor 40. Thus, the electrical conductor 40 is contacted at two locations, for instance radially opposite locations of the contact body 21 within each of the slots 34 and 35. The method can include the step of applying electrical current between the electrical cable 32 and the complementary electrical component 26. The method can include the step of applying a data signal between the electrical cable and the complementary electrical component.

A method of selling one or more up to all of the insulation displacement contact 20, the insulation displacement connector 64, and the connector assembly 66 can include the step of teaching to a third party one or more up to all of the method steps disclosed above, the insulation displacement contact 20, the insulation displacement connector 64, and the connector assembly 66. The method can further include the step of selling to the third party at least one or more up to all of the insulation displacement contact 20, the insulation displacement connector 64, and the electrical connector assembly 66.

The foregoing description is provided for the purpose of explanation and is not to be construed as limiting the invention. While various embodiments have been described with reference to preferred embodiments or preferred methods, it is understood that the words which have been used herein are words of description and illustration, rather than words of limitation. Furthermore, although the embodiments have been described herein with reference to particular structure, methods, and embodiments, the invention is not intended to be limited to the particulars disclosed herein. For instance, it should be appreciated that structure and methods described in association with one embodiment are equally applicable to all other embodiments described herein unless otherwise indicated. Thus, each insulation displacement contact can include one or more up to all features, including structure and methods, alone or in combination, as the other insulation displacement contacts as described herein. Those skilled in the relevant art, having the benefit of the teachings of this specification, may effect numerous modifications to the invention as described herein, and changes may be made without departing from the spirit and scope of the invention, for instance as set forth by the appended claims.

What is claimed:

1. An insulation displacement contact, comprising:

a mounting portion that is configured to be mounted onto a complementary electrical component, the mounting portion defining first and second opposed ends spaced from each other along a longitudinal direction;

a mating portion that extends out with respect to the mounting portion, the mating portion including 1) a first arm that extends out from the first end of the mounting portion and toward the second end of the mounting portion, and 2) a second arm that extends out from the second end of the mounting portion and extends toward the first end of the mounting portion; and at least one retention wall that extends from one of the first and second ends, the at least one retention wall configured to be received in a connector housing that is secured onto the insulation displacement contact, and the at least one retention wall defining an inner surface that faces the first arm so as to define a retention gap between the inner surface and the first arm, the retention gap sized to receive a portion of the connector housing when the connector housing is secured onto the insulation displacement contact, wherein the first and second arms are spaced from each other so as to define first and second slots that are aligned with each other along the longitudinal direction and configured to receive an electrical cable, wherein at least one of the first and second arms includes at least one piercing member that at least partially defines the at least one of the slots, and is configured to pierce an outer electrically insulative layer of the electrical cable and contacts an electrical conductor of the electrical cable that is disposed inside the electrically insulative layer when the electrical cable is disposed in the at least one of the slots.

2. The insulation displacement contact as recited in claim 1, further comprising a dimple that extends from the at least one retention wall along the longitudinal direction toward the first arm.

3. The insulation displacement contact as recited in claim 1, wherein at least a portion of the at least one retention wall is aligned with the first arm along the longitudinal direction.

4. The insulation displacement contact as recited in claim 1, wherein the at least one retention wall is a first retention wall, and the insulation displacement contact further comprises a second retention wall that extends from the second end.

5. The insulation displacement contact as recited in claim 4, wherein the second retention wall defines a second inner surface that faces the second arm so as to define a second retention gap from the second inner surface to the second arm.

6. The insulation displacement contact as recited in claim 5, further comprising a second dimple that extends from the second retention wall along the longitudinal direction toward the second wall.

7. The insulation displacement contact as recited in claim 4, wherein at least a portion of the second retention wall is aligned with the second arm along the longitudinal direction.

8. An insulation displacement contact, comprising:

a mounting portion that is configured to be mounted onto a complementary electrical component, the mounting portion defining first and second opposed ends spaced from each other along a longitudinal direction;

a mating portion that extends out with respect to the mounting portion, the mating portion including 1) a first arm that extends out from the first end of the mounting portion and toward the second end of the mounting portion, and 2) a second arm that extends out from the second end of the mounting portion and extends toward the first end of the mounting portion, each of the first and second arms defining a respective proximal portion that is attached to the mounting portion and a distal portion opposite the proximal portion, and each of the first and second arms being cantilevered such that the distal portion of each of the first and second arms is free from attachment to the mounting portion and is rotatable with respect to the proximal portion of another of the first and second arms; and at least one retention wall that extends from one of the first and second ends, the at least one retention wall configured to be received in a connector housing that is secured onto the insulation displacement contact, wherein the first and second arms are spaced from each other so as to define first and second slots that are aligned with each other along the longitudinal direction and configured to receive an electrical cable, wherein at least one of the first and second arms includes at least one piercing member that at least partially defines the at least one of the slots, and is configured to pierce an outer electrically insulative layer of the electrical cable and contacts an electrical conductor of the electrical cable that is disposed inside the electrically insulative layer when the electrical cable is disposed in the at least one of the slots.

9. The insulation displacement contact as recited in claim 8, wherein at least a portion of the first retention wall is aligned with the distal portion of the first arm along the longitudinal direction.

10. The insulation displacement contact as recited in claim 8, wherein the proximal portion of the first arm defines a first inner surface, and the distal portion of the second arm defines a second inner surface that is opposite the first inner surface so as to define the first slot, and at least one of the first and second inner surfaces defines the at least one piercing member.

11. The insulation displacement contact as recited in claim 10, wherein the distal portion of the first arm defines a third inner surface, and the proximal portion of the second arm defines a fourth inner surface that is opposite the third inner surface so as to define the second slot, and at least one of the third and fourth inner surfaces further defines the at least one piercing member.

12. The insulation displacement contact as recited in claim 8, wherein at least a portion of each of the first and second arms tapers inwardly along a direction from the respective proximal portion toward the respective distal portion.

13. The insulation displacement contact as recited in claim 12, wherein each of the first and second arms comprises a respective bridge that extends between the proximal and distal portions, the bridge spaced from the mounting portion.

14. The insulation displacement contact as recited in claim 12, wherein the bridges of each of the first and second arms are tapered along a direction from the respective proximal portion toward the respective distal portion.

15. The insulation displacement contact as recited in claim 14, wherein the proximal portion of the first arm extends out from the second end, and the proximal portion of the second arm extends out from the first end.

16. The insulation displacement contact as recited in claim 2, wherein the mating portion defines at least one shoulder that partially defines at least one of the slots.

17. The insulation displacement contact as recited in claim 1, wherein the mating portion is monolithic with the mounting portion.

18. An insulation displacement connector comprising the insulation displacement contact as recited in claim 1, and a connector housing that includes a housing body and at least one cable retention channel that extends through the housing body and is configured to receive the electrical cable, wherein the housing body is further configured to receive the insulation displacement contact.

19. The insulation displacement connector as recited in claim 18, further wherein the connector housing further comprises a pair of opposed end walls spaced from each other along the longitudinal direction and at least one retention wall spaced from a respective one of the end walls along the longitudinal direction so as to define a gap between the at least one retention wall of the housing and the respective one of the end walls, the gap sized to receive the at least one retention wall of the insulation displacement contact.

20. The insulation displacement connector as recited in claim 8, wherein the proximal portion of the first arm is opposite the distal portion of the second arm along a lateral direction perpendicular to the longitudinal direction so as to define the first slot, and the proximal portion of the second arm is opposite the distal portion of the first arm along the lateral direction so as to define the second slot.

* * * * *